United States Patent [19]

Gruber et al.

[11] 4,454,214

[45] Jun. 12, 1984

[54] TONER COMPOSITIONS CONTAINING PYRIDINIUM TETRAFLUOROBORATES

[75] Inventors: Robert J. Gruber, Pittsford; Paul C. Julien, Webster; Raymond A. Yourd, III, Rochester, all of N.Y.

[73] Assignee: Xerox Corporation, Stamford, Conn.

[21] Appl. No.: 446,739

[22] Filed: Dec. 3, 1982

[51] Int. Cl.[3] ..... G03G 9/08

[52] U.S. Cl. ..... 430/110

[58] Field of Search ..... 430/110

[56] References Cited

U.S. PATENT DOCUMENTS

| | | | |
|---|---|---|---|
| 3,893,935 | 7/1975 | Jadwin et al. | 252/62.1 |
| 4,298,672 | 11/1981 | Lu | 430/108 |
| 4,304,830 | 12/1981 | Bolte et al. | 430/110 X |
| 4,324,851 | 4/1982 | Lu et al. | 430/110 X |

*Primary Examiner*—Roland E. Martin, Jr.
*Attorney, Agent, or Firm*—E. O. Palazzo

[57] ABSTRACT

This invention relates to improved positively charged toner compositions for use in developing electrostatic images contained in electrostatographic imaging devices wherein fusing is accomplished with a fuser roll fabricated from lead oxide and a vinylidene fluoride hexafluoropropylene copolymer, which composition is comprised of resin particles, pigment particles, and as the charge enhancing additive present in an amount of from about 0.1 percent by weight to about 10 percent by weight, a pyridinium tetrafluoroborate of the following formula:

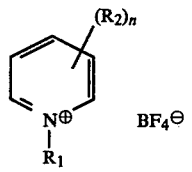

wherein $R_1$ is an alkyl group containing from about 1 carbon atom to about 22 carbon atoms, and $R_2$ is an alkyl group containing from about 1 carbon atom to about 8 carbon atoms, or a halogen, and n is zero or 1.

28 Claims, No Drawings

TONER COMPOSITIONS CONTAINING PYRIDINIUM TETRAFLUOROBORATES

BACKGROUND

This invention is generally directed to toner compositions, and developer compositions and the use of these compositions in electrostatographic imaging systems. More specifically, the present invention is directed to toner compositions, including magnetic toner compositions and colored toner compositions containing a thermally stable tetrafluoroborate charge enhancing additive. Positively charged toner compositions containing these additives are particularly useful in electrostatographic imaging systems having incorporated therein a Viton coated fuser roll, since the tetrafluoroborates involved do not react with the Viton, causing undesirable decomposition thereof, and adversely affecting image quality.

Positively charged toner compositions containing charge enhancing additives are generally known. Thus, for example, there is disclosed in U.S. Pat. No. 3,893,935, the use of certain quaternary ammonium compounds as charge control agents for electrostatic toner compositions. This patent teaches the incorporation of a specific quaternary ammonium compound into toner particles for the purpose of obtaining particles exhibiting relatively high uniform and stable net toner charge when mixed with a suitable carrier vehicle. A similar teaching is disclosed in U.S. Pat. No. 4,079,014 with the exception that a different charge control additive is selected, namely, a diazo type material.

Further there is described in U.S. Pat. No. 4,298,672 developer compositions containing as a charge enhancing additive an alkyl pyridinium compound including, for example, cetyl pyridinium chloride. This patent also discloses that the anion on the alkyl pyridinium material can be selected from halides, sulfates, sulfonates, nitrate, and borate. While these developer compositions are sufficient for their intended purposes it appears that the alkyl pyridinium compounds react with the polymer contained on Viton fuser rolls causing decomposition thereof. Other patents disclosing charge control additives include U.S. Pat. Nos. 3,944,493, 4,007,293, and 4,079,014.

Several prior art charge control agents of the prior art interact with certain fuser rolls, such as for example, the Viton fuser roll, used in electrostatographic systems. This interaction causes the fuser to be adversely affected, resulting in deterioration of the image quality. For example, Viton fuser rolls discolor and turn black, develop multiple surface cracks and harden, when certain charge control additive compounds are contained in the toner mixture.

One Viton fuser roll selected for use in electrostatographic copying machines, is comprised of a soft roll fabricated from lead oxide, and duPont Viton E-430 resin, a vinylidene fluoride hexafluoropropylene copolymer. This roll contains approximately 15 parts of lead oxide, and 100 parts of Viton E-430, which mixture is blended and cured on the roll substrate at elevated temperatures. Apparently the function of the lead oxide is to generate unsaturation by dehydrofluorination for crosslinking, and to provide release mechanisms for the toner composition. Excellent image quality has been obtained with Viton fuser rolls, however, in some instances there results a toner fuser compatibility problem when charge control agents are part of the toner mixture. For example, it appears that certain specific charge control additives, such as quaternary ammonium compounds, and alkyl pyridinium compounds, including cetyl pyridinium chloride, react with the Viton of the Viton fuser roll. For example, cetyl pyridinium chloride when part of the toner mixture appears to be catalytically decomposed by the lead oxide contained in the fuser roll, resulting in a highly unsaturated compound, which polymerizes and condenses with the unsaturated Viton E-430 material. In view of this, the Viton fuser roll turns black, develops multiple surface cracks, and the surface thereof hardens, thereby resulting in image quality deterioration.

The art of xerography continues to advance and recently, there has been disclosed layered photoresistive imaging devices comprised of generating layers and transport layers. These devices usually are charged negatively, rather than positively as is the situation with the selenium photoreceptor, thereby requiring a toner composition that is positively charged in order that the toner particles may be suitable attracted to the electrostatic latent image contained on the photoreceptor surface. In view of this development, extensive efforts have been devoted to obtaining developer compositions containing toner resins which are positively charged. Generally, charge control additives are selected for the purpose of imparting the appropriate positive charge to the toner resins. While many charge control additives are known, there continues to be a need for new charge control additives, particularly those additives which will not interact with Viton type fuser rolls. Additionally, there continues to be a need for charge control additives which are thermally stable at high temperatures. Moreover, there continues to be a need for positively charged toner and developer compositions which are humidity insensitive since it is known that moisture contained in the atmosphere, or moisture from many other sources, can effect adversely the electrical properties of the toner compositions involved.

SUMMARY OF THE INVENTION

It is an object of the present invention to provide a toner composition containing a charge enhancing additive, which overcomes the above-noted disadvantages.

A further object of the present invention is to provide a charge enhancing additive which is thermally stable at high temperatures.

Another object of the present invention is the provision of a charge enhancing additive which does not interact and/or attack Viton rubber selected for use in certain fusing roll systems.

In another object of the present invention there is provided a developer composition containing positively charged toner particles, carrier particles and a tetrafluoroborate charge enhancing additive.

In yet a further object of the present invention there are provided developer compositions which are water insensitive and have rapid admix properties.

In a further object of the present invention there are provided magnetic toner compositions, and colored toner compositions containing positively charged toner particles, carrier particles, and a tetrafluoroborate charge enhancing additive.

These and other objects of the present invention are accomplished by providing dry electrostatic toner compositions containing resin particles, pigment particles, and as a charge enhancing additive, a pyridinium tetrafluoroborate of the following formula:

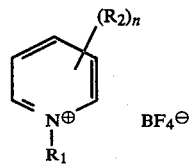

wherein $R_1$ is an alkyl group containing from about 1 carbon atom to about 22 carbon atoms, and $R_2$ is an alkyl group containing from about 1 carbon atom to about 8 carbon atoms, or a halogen such as chlorine, bromine, fluorine, or iodine and n is zero or the number 1. Preferred pyridinium tetrafluorate charge enhancing additives include those where $R_1$ is an alkyl group containing from about 1 carbon atoms to about 20 carbon atoms, and $R_2$ is methyl or ethyl, or wherein n is zero.

Illustrative examples of alkyl groups include methyl, ethyl, propyl, butyl, pentyl, hexyl, octyl, nonyl, decyl, cetyl, nonyl, eicosyl, and the like with cetyl being preferred.

Generally from about 0.1 weight percent to about 10 weight percent and preferably from about 1 weight percent to about 2 weight percent, of the pyridinium tetrafluoroborate is selected for mixing with the toner particles, however the charge enhancing additive of the present invention can be used in various other amounts providing the objectives of the present invention are accomplished. The pyridinium tetrafluoroborate charge enhancing additive of the present invention can be blended into the toner composition, or coated on the pigment particles, such as carbon black, which are used as the colorants in the developer composition. When employed as a coating, the charge enhancing additive of the present invention is present in an amount of from about 0.1 weight percent to about 5 weight percent and preferably in an amount of from about 0.3 weight percent to about 1 weight percent.

Illustrative examples of suitable toner resins selected for the toner and developer compositions of the present invention include polyamides, epoxies, polyurethanes, vinyl resins and polymeric esterification products of a dicarboxylic acid and a diol comprising a diphenol. Any suitable vinyl resin may be selected for the toner resins of the present application including homopolymers or copolymers of two or more vinyl monomers. Typical of such vinyl monomeric units include: styrene, p-chlorostyrene vinyl napthalene unsaturated monoolefins such as ethylene, propylene, butylene, isobutylene and the like; vinyl halides such as vinyl chloride, vinyl bromide, vinyl fluoride, vinyl acetate, vinyl propionate, vinyl benzoate, vinyl butyrate and the like; vinyl esters such as esters of monocarboxylic acids including methyl acrylate, ethyl acrylate, n-butylacrylate, isobutyl acrylate, dodecyl acrylate, n-octyl acrylate, 2-chloroethyl acrylate, phenyl acrylate, methylalpha-chloroacrylate, methyl methacrylate, ethyl methacrylate, butyl methacrylate, and the like; acrylonitrile, methacrylonitrile, acrylamide, vinyl ethers, such as vinyl methyl ether, vinyl isobutyl ether, vinyl ethyl ether, and the like; vinyl ketones such as vinyl methyl ketone, vinyl hexyl ketone, methyl isopropenyl ketone and the like; vinylidene halides such as vinylidene chloride, vinylidene chlorofluoride and the like; and N-vinyl indole, N-vinyl pyrrolidene and the like; and mixtures thereof.

As one preferred toner resin there can be selected the esterification products of a dicarboxylic acid and a diol comprising a diphenol. These materials are illustrated in U.S. Pat. No. 3,655,374, the disclosure of which is totally incorporated herein by reference, the diphenol reactant being of the formula as shown in Column 4, beginning at line 5 of this patent and the dicarboxylic acid being of the formula as shown in Column 6. Other preferred toner resins include styrene/methacrylate copolymers, and styrene/butadiene copolymers. The resin is present in an amount so that the total of all ingredients used in the toner composition total about 100 percent, thus when 5 percent by weight of the pyridinium tetrafluoroborate composition is used, with 10 percent by weight of pigment such as carbon black, about 85 percent by weight of resin material is selected.

Numerous suitable pigments or dyes can be selected as the colorant for the toner particles including those well known, such as for example, carbon black, nigrosine dye, aniline blue, magnetites and mixtures thereof. The pigment, which is preferably carbon black, should be present in a sufficient amount to render the toner composition highly colored in order that it will cause the formation of a clearly visible image on a recording member. Generally, the pigment particles are present in amounts of from about 3 percent by weight to about 20 percent by weight; based on the total weight of the toner composition, however, lesser or greater amounts of pigment particles can be selected providing the objectives of the present invention are achieved.

When the pigment particles are comprised of magnetites, which are a mixture of iron oxides ($Fe_2O_3.Fe_3O_4$) such as those commercially available as Mapico Black, these pigments are present in the toner composition in an amount of from about 10 percent by weight to about 70 percent by weight, and preferably in an amount of from about 20 percent by weight to about 50 percent by weight. Toner compositions containing such pigments are referred to as magnetic toner compositions.

Illustrative examples of carrier particles that can be selected for mixing with the toner particles of the present invention include those particles that are capable of triboelectrically obtaining a charge of opposite polarity to that of the toner particles. Accordingly, the carrier particles of the present invention are selected so as to be of a negative polarity in order that the toner particles which are positively charged will adhere to and surround the carrier particles. Illustrative examples of such carrier particles include granular zircon, granular silicon, methyl methacrylate, glass, steel, nickel, iron ferrites, silicon dioxide, and the like. Additionally, there can be selected as carrier particles nickel berry carriers as disclosed in U.S. Pat. No. 3,847,604, which carriers are comprised of nodular carrier beads of nickel, characterized by surfaces of reoccurring recesses and protrusions thereby providing particles with a relatively large external area.

The diameter of the carrier particles can vary but generally are from about 50 microns to about 1,000 microns, thus allowing these particles to possess sufficient density and inertia to avoid adherence to the electrostatic images during the development process. Carrier particles can be mixed with the toner particles in various suitable combinations, however, best results are obtained when about 1 part per toner to about 10 parts to about 200 parts by weight of carrier are mixed.

The toner composition of the present invention can be prepared by a number of known methods, including melt blending the toner resin particles, pigment particles, and the pyridinium tetrafluoroborate charge enhancing additive of the present invention, followed by mechanical attrition. Other methods include those well known in the art such as spray drying, melt dispersion, dispersion polymerization, and suspension polymerization. In one dispersion polymerization method, a solvent dispersion of the resin particles, the pigment particles, and the pyridinium tetrafluoroborate charge enhancing additive are spray dried under controlled conditions to result in the desired product. Toner compositions prepared in this manner result in a positively charged toner composition in relation to the carrier materials selected, and these materials exhibit the improved properties as mentioned hereinbefore.

Also embraced within the present invention are colored toner compositions containing the toner resin particles, carrier particles and tetrafluoroborate charge enhancing additives specified, and as pigments or colorants, magenta, cyan and/or yellow particles, as well as mixtures thereof. More specifically, with regard to the production of color images utilizing a developer composition containing the charge enhancing additives of the present invention, illustrative examples of magenta materials that may be selected as pigments, include for example, 2,9-dimethyl-substituted quinacridone and anthraquinone dye identified in the color index as Cl 60710, Cl Dispersed Red 15, a diazo dye identified in the color index as Cl 26050, Cl Solvent Red 19, and the like. Illustrative examples of cyan materials that may be used as pigments include copper tetra-4(octadecyl sulfonamido) phthalocyanine, X-copper phthalocyanine pigment listed in the color index as Cl 74160, Cl Pigment Blue, and Anthradanthrene Blue, identified in the color index as Cl 69810, Special Blue X-2137, and the like, while illustrative examples of yellow pigments that may be selected include diarylide yellow 3,3-dichlorobenzidene acetoacetanilides, a monoazo pigment identified in the color index as Cl 12700, Cl Solvent Yellow 16, a nitrophenyl amine sulfonamide identified in the color index as Foron yellow SE/GLN, Cl dispersed yellow 33, 2,5-dimethoxy-4-sulfonanilide phenylazo-4'-chloro-2,5-dimethoxy aceto-acetanilide, permanent yellow FGL, and the like.

The color pigments, namely, cyan, magenta, and yellow pigments when utilized with the charge enhancing additives of the present invention are generally present in an amount of from about 2 weight percent to about 15 weight percent based on the weight of the toner resin particles.

The toner and developer compositions of the present invention may be selected for use in developing images in electrostatographic imaging systems, containing therein conventional photoreceptors providing that they are capable of being charged negatively. This usually occurs with organic photoreceptors illustrative examples of which include layered photoresponsive devices composed of transport layers and photogenerating layers, reference U.S. Pat. No. 4,225,990, the disclosure of which is totally incorporated herein by reference, and other similar layered photoresponsive devices. Examples of generating layers include trigonal selenium, metal phthalocyanines, metal free phthalocyanines and vanadyl phthalocyanines, while examples of the charge transport layers include the diamines as disclosed in U.S. Pat. No. '990. Other photoresponsive devices useful in the present invention include polyvinylcarbazole 4-dimethylaminobenzylidene, benzhydrazide; 2-benzylidene-aminocarbazole, 4-dimethaminobenzylidene, (2-nitro-benzylidene)-p-bromoaniline; 2,4-diphenyl-quinazoline; 1,2,4-triazine; 1,5-diphenyl-3-methyl pyrazoline 2-(4'-dimethyl-amino phenyl)-benzoaxzole; 3-aminocarbazole, polyvinyl carbazole-trinitrofluorenone charge transfer complex; and mixtures thereof.

The pyridinium tetrafluoroborate charge enhancing additives of the present invention can be prepared by a number of suitable methods including the reaction of an appropriate alkali tetrafluoroborate, such as sodium pyridinium tetrafluoroborate, in the presence of a water solvent mixture, including organic solvents such as acetone, the reaction occuring at a temperature of from about 0° C. to about 100° C. The reaction mixture is stirred followed by cooling in ice, wherein the resulting precipitate product is separated from the filtrate by known methods. Thus, sodium pyridinium tetrafluoroborate can be prepared by reacting a suitable alkylpyridinium chloride, such as cetylpyridinium chloride, with sodium tetrafluoroborate in a suitable solvent mixture. The resulting final pyridinium tetrafluoroborate product is identified by infrared and spectographic analysis. Elemental analysis for carbon, hydrogen boron, fluorine, and nitrogen was selected for determining the structure of the pyridinium tetrafluoroborate compound formed.

The following examples are being supplied to further define various species of the present invention, it being noted that these examples are intended to illustrate and not limit the scope of the present invention. Parts and percentages are by weight unless otherwise indicated.

EXAMPLE I

There was prepared cetylpyridinium tetrafluoroborate by dissolving 50.0 grams (0.14 mole) of cetylpyridinium chloride (CPC) in 50 milliliters (ml) of a 1.1 water: acetone mixture, in a 2,000 ml 3-necked round bottom flask equipped with an air driven stirrer, a dropping funnel, and a thermometer. Sixteen and nine-tenths grams (0.154 mole) of $NaBF_4$ was then dissolved in 150 milliliters water and filtered into the dropping funnel. The $NaBF_4$ solution was added dropwise with vigorous stirring to the CPC solution contained in the flask. After several minutes, a white precipitate began to form. Subsequent to the addition of the entire $NaBF_4$ solution, the resulting mixture was cooled in an ice bath, and stirred for one hour.

The resulting precipitate was filtered and washed three times with 50 ml of water, followed by drying in vacuum overnight at 43° C.

There resulted cetylpyridinium tetrafluoroborate, 54.15 grams (99.1 percent yield) having a melting point of 80° C.–88.5° C. This product was subjected to a carbon, hydrogen, nitrogen, boron, fluorine, elemental analysis with the following results:

| Elemental Analysis | C | H | N | B | F |
|---|---|---|---|---|---|
| Theory | 64.45 | 9.79 | 3.58 | 2.76 | 19.42 |
| Found | 64.64 | 9.66 | 3.37 | 2.98 | 19.42 |

Experimental data indicates that the temperature at which decomposition of the cetyl pyridinium tetrafluoroboroate occurs, (IT), that is where weight loss of material begins was 261° C., while the temperature at which the rate of decomposition is the highest, (DT) for the cetyl pyridinium tetrafluoroborate is 361° C.

In comparison, the known charge enhancing additive cetyl pyridinium chloride, has a melting point of 81° C., an IT temperature of 160° C. and a DT temperature of 202° C.

EXAMPLE II

There was prepared a toner composition by melt blending at a temperature of 100° C., followed by mechanical attrition, 2 percent by weight of cetyl pyridinium tetrafluoroborate, prepared in accordance with Example I, 6 percent by weight of Regal 330 carbon black, and 92 percent by weight of a styrene butadiene resin, containing 89 percent by weight of styrene, and 11 percent by weight of butadiene, commercially available from Goodyear Chemical Company as Pliolite. The resulting toner was classified in order to remove particles smaller than 5 microns in diameter.

The triboelectric charge on this toner was measured against a Hoeganoes steel carrier coated with 0.15 percent by weight of Kynar 301, a polyvinylidene fluoride resin commercially available from Pennwalt Company, at 3 percent toner concentration, such triboelectric measurements being accomplished on a toner charge spectograph. This instrument dispenses toner particles in proportion to the charge to diameter ratio and with the aid of automated microscopy can generate charge distribution histograms for selected toner size classes. The resulting toner compositions had a positive charge of 1.6 femtocoulombs per micron.

When uncharged toner particles containing 92 percent by weight of the above Pliolite resin, 6 percent by weight of carbon black, and 2 percent by weight of cetyl pyridinium tetrafluoroborate, were mixed with a charge developer composition containing 2 percent by weight of cetyl pyridinium tetrafluoroborate, 6 percent by weight of Regal 330 carbon black, and 92 percent by weight of a styrene butadiene resin, containing 89 percent by weight of styrene, and 11 percent by weight of butadiene, commercially available from Goodyear Chemical Company as Pliolite, the admix charging rate for the uncharged toner composition was less than 15 seconds. Also admix charging experiments evidenced that the uncharged toner particles had fast charging properties when fresh uncharged toner particles were added to the charged developer composition, that is the fresh toner particles became positively charged in less than 15 seconds.

The above experiments were repeated for the purpose of determining the charge admix properties of a toner composition that did not contain the pyridinium tetrafluoroborate charge enhancing additive with the result that there was obtained a toner composition, comprised of 94 percent by weight of a styrene butadiene resin, containing 89 percent by weight of styrene, and 11 percent by weight of butadiene, commercially available as Pliolite, and 6 percent by weight of Regal 330 carbon black, that had a charge thereon of 0.6 femtocoulombs per micron, and an admix rate greater than 8 minutes. These measurements were again accomplished on a toner charge spectrograph.

The above developer composition was then selected for developing images in a xerographic imaging device, containing a layered photoreceptor comprised of a Mylar substrate, overcoated with a photogenerating layer of trigonal selenium, dispersed in a polyvinyl carbazole binder, and as top layer in contact with the photogenerating layer, charge transport molecules N,N'-diphenyl-N,N'-bis(3-methylphenyl)1,1'-biphenyl-4,4'-diamine, dispersed in a polycarbonate resin commercially available as Makralon, which device was prepared in accordance with the disclosure of U.S. Pat. No. 4,255,990, and there resulted high quality images. The device selected also contained a Viton fuser roll and visual observation after 50,000 imaging cycles indicated that no damage occurred to the Viton fuser roll, that is, the Viton did not turn black, did not crack and the surface did not harden, but rather remained smooth and soft, although very slightly darkened.

When cetyl pyridinium chloride in the same amount, was substituted for the cetyl pyridinium tetrafluoroborate in the above developer composition, and images were developed with this composition, excellent quality images were initially obtained, however, the Viton fuser roll blackened and appeared to develop surface cracks; and the Viton surface hardened, after about 5,000 imaging cycles. Image quality deteriorated rapidly after about 5,000 imaging cycles, and image resolution was very poor due to the reaction of the cetyl pyridinium chloride with the Viton fuser roll.

Additionally, toner compositions containing the cetyl pyridinium tetrafluoroborate charge enhancing additive were humidity insensitive in that the initial charge was only reduced from 1.6 femtocoulombs to 1.4 femtocoulombs, while toner compositions containing the cetyl pyridinium chloride were humidity sensitive in that the charge was significantly reduced from 1.8 femtocoulombs to 1.1 femtocoulombs. These humidity sensitivity measurements were accomplished by the following procedure: The developer compositions involved, one of which contains cetyl pyridinium tetrafluoroborate, and one of which contains cetyl pyridinium chloride, was placed in a humidity chamber maintained at a temperature of 80° F. at a relative humidity of 80 percent. These conditions were maintained for 24 hours. The charge on the toner composition and the admix rate were then compared to the results at room temperature and 35 percent relative humidity.

EXAMPLE III

The procedure of Example I was repeated with the exception that the toner composition prepared contained 92 percent by weight of polyester resin particles resulting from the condensation of bis-phenol A, propylene glycol, and fumaric acid. Other toner compositions were prepared in substantially a similar manner with the exception that there was used as the toner resin particles, a styrene butadiene resin, containing about 90 percent by weight of styrene and 10 percent by weight of butadiene, commercially available from Goodyear Chemical Company, and styrene n-butylmethacrylate resins, containing 58 percent by weight of styrene and 42 percent by weight of n-butylmethacrylate.

When these toner compositions were selected for use in the electrostatographic developing system of Example I, substantially similar results were obtained, that is high quality images resulted and the Viton fuser roll did not develop surface cracks, did not turn black or discolor, and the surface thereof did not harden after 35,000 imaging cycles.

The Viton fuser test was accomplished by inserting a strip of Viton approximately $\frac{1}{8}''$ thick, a length of $\frac{3}{4}''$ and a width of $\frac{1}{2}''$, in separate charge enhancing additives contained in a test tube containing 50 percent thereof of the charge enhancing additive to be tested. The test tube was then heated to 200° C. for a period of 24 hours and the Viton fuser strip was removed. After removal and drying, the Viton fuser strip was examined visually for discoloration, surface cracks and a determination was made as to whether the surface thereof hardened by for example, using a durometer, which measures indentation hardness.

Other modifications of the present invention may occur to those skilled in the art based upon a reading of the present disclosure and these modifications are intended to be included within the scope of the present invention.

We claim:

1. An improved positively charged toner composition for use in developing electrostatic images contained in electrostatographic imaging devices wherein fusing is accomplished with a fuser roll fabricated from lead oxide and a vinylidene fluoride hexafluoropropylene copolymer, which composition is comprised of resin particles, pigment particles, and as the charge enhancing additive present in an amount of from about 0.1 percent by weight to about 10 percent by weight, a pyridinium tetrafluoroborate of the following formula:

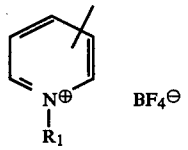

wherein $R_1$ is an alkyl group containing from 1 carbon atom to about 22 carbon atoms.

2. An improved toner composition in accordance with claim 1 wherein $R_1$ is an alkyl group containing from about 15 carbon atoms to about 20 carbon atoms.

3. An improved toner composition in accordance with claim 1 wherein $R_1$ is cetyl.

4. An improved toner composition in accordance with claim 1 wherein n is zero.

5. An improved toner composition in accordance with claim 1 wherein the charge enhancing additive is cetyl pyridinium tetrafluoroborate.

6. An improved toner composition in accordance with claim 1 wherein the cetyl pyridinium tetrafluoroborate selected has a melting point of from about 86° C. to about 88° C.

7. An improved toner composition in accordance with claim 1 wherein the pyridinium tetrafluoroborate is present in an amount of from about 2 percent by weight to about 5 percent by weight.

8. An improved toner composition in accordance with claim 1 wherein the resin particles are a styrene butadiene copolymer, polyesters, or a styrene n-butyl methacrylate copolymer, and the pigment particles are comprised of carbon black.

9. An improved developer composition comprised of the positively charged toner composition of claim 1, and carrier particles.

10. A developer composition in accordance with claim 9 wherein the carrier particles are comprised of steel, coated with a polymeric resin.

11. An improved developer composition in accordance with claim 9 wherein the pyridinium tetrafluoroborate composition is cetyl pyridinium tetrafluoroborate.

12. An improved toner composition in accordance with claim 1 wherein the pigment particles are selected from the group consisting of magenta, cyan, and yellow pigments.

13. An improved toner composition in accordance with claim 1 wherein the pigment particles are selected from magnetites, thereby resulting in a magnetic toner composition.

14. An improved toner composition in accordance with claim 12 wherein the magenta pigment is a 2,9-dimethyl-substituted quinacridone, the cyan pigment is copper tetra-4 (octadecyl sulfonamido) phthalocyanine, and the yellow pigment is a diarylide yellow 3,3-dichlorobenzidene acetoacetanilide.

15. A toner composition in accordance with claim 12 wherein the pigments are present in an amount of from about 2 percent by weight to about 15 percent by weight.

16. A toner composition in accordance with claim 13 wherein the magnetites are comprised of a mixture of iron oxides.

17. A toner composition in accordance with claim 13 wherein the magnetites are present in an amount of from about 10 percent by weight to about 70 percent by weight.

18. A toner composition in accordance with claim 13 wherein the magnetites are present in an amount of from about 20 percent by weight to 50 percent by weight.

19. A developer composition in accordance with claim 9 wherein the toner resin particles are a styrene butadiene copolymer, polyesters, or a styrene n-butyl-methacrylate copolymer.

20. A developer composition in accordance with claim 9 wherein the pigment particles are comprised of carbon black.

21. A developer composition in accordance with claim 9 wherein the pigment particles are selected from the group consisting of magenta, cyan, and yellow pigments.

22. A developer composition in accordance with claim 9 wherein the pigment particles are selected from magnetites thereby resulting in a magnetic toner composition.

23. A developer composition in accordance with claim 22 wherein the magnitites are comprised of mixture of iron oxides.

24. A developer composition in accordance with claim 23 wherein the iron oxides are present in an amount of from about 10 percent by weight to about 70 percent by weight.

25. A developer composition in accordance with claim 23 wherein the magnitites are present in an amount of from about 20 percent by weight to about 50 percent by weight.

26. A developer composition in accordance with claim 11 wherein the cetyl pyridinium tetrafluoroborate is present in an amount of from about 2 percent by weight to about 5 percent by weight.

27. A developer composition in accordance with claim 10 wherein the polymeric resin is a fluoropolymer.

28. A developer composition in accordance with claim 10 wherein the polymeric resin is polyvinylidene fluoride.

* * * * *